US005340709A

United States Patent [19]

Hagemann et al.

[11] Patent Number: 5,340,709

[45] Date of Patent: Aug. 23, 1994

[54] PHOTOGRAPHIC RECORDING MATERIAL

[75] Inventors: Jörg Hagemann, Cologne; Günter Helling, Odenthal, both of Fed. Rep. of Germany

[73] Assignee: AGFA-Gevaert AG, Leverkusen, Fed. Rep. of Germany

[21] Appl. No.: 28,815

[22] Filed: Mar. 10, 1993

[30] Foreign Application Priority Data

Mar. 23, 1992 [DE] Fed. Rep. of Germany ..... 4209346

[51] Int. Cl.[5] ..... G03C 1/34; G03C 7/38

[52] U.S. Cl. ..... 430/551; 430/558

[58] Field of Search ..... 430/551, 609, 607, 558

[56] References Cited

U.S. PATENT DOCUMENTS 4,656,125 4/1987 Renner et al. ..... 430/551
4,943,519 7/1990 Helling et al. ..... 430/609

FOREIGN PATENT DOCUMENTS 0176845 4/1986 European Pat. Off. .
0267618 5/1988 European Pat. Off. ..... 430/551

OTHER PUBLICATIONS

Patent Abstracts of Japan, vol. 12, No. 123 (P-655) (P-2859), Jan. 14, 1988 & JP-A-62 169 160 (Konishiroku), Jul. 25, 1987.
Abstract (from "Orbit") of JP-A-62 169 160.
Abstract (from "Orbit") of EP-A-0 176 845.

*Primary Examiner*—Lee C. Wright
*Attorney, Agent, or Firm*—Connolly and Hutz

[57] ABSTRACT

Compounds of Formula I are suitable as light stabilizers for the image dyes produced by chromogenic development from pyrazoloazole couplers (I)

In Formula I, $R^1$ represents H, a group that can be split off under alkaline conditions, alkyl or aryl;

$R^2$ represents —OH, alkyl, aryl, alkoxy or $$-(A)_n-\overset{\overset{R^7}{|}}{N}-CO-NH-R^8,$$

$R^3$, $R^4$, $R^5$ and $R^6$ represent H, —OH, —COOH, $-SO_3H$, $-SO^2H$, alkyl, aryl, alkoxy, sulphonyl, sulphamoyl, acylamino or $$-(A)_n-\overset{\overset{R^7}{|}}{N}-CO-NH-R^8,$$

at least one of the groups $R^2$, $R^3$, $R^4$, $R^5$ and $R^6$ being a group of the formula $$-(A)_n-\overset{\overset{R^7}{|}}{N}-CO-NH-R^8;$$

A represents alkylene with 1–6 C atoms;

n represents 0 or 1, $R^7$ represents H or alkyl, optionally substituted alkyl, $R^8$ represents optionally substituted alkyl, cycloalkyl or aryl with 4–20 C atoms;

$R^1$ and $R^3$ can form a 5- or 6-membered ring, in which case $R^2$=—OH or alkoy;

$R^2$ and $R^4$ can form a 5- or 6-membered carbocyclic ring.

4 Claims, No Drawings

PHOTOGRAPHIC RECORDING MATERIAL

The invention relates to a photographic recording material comprising at least one silver halide emulsion layer that contains novel light stabilizers for the magenta azomethine dyes of the pyrazoloazole type produced by chromogenic development.

It is known to produce coloured photographic images by chromogenic development, that is developing imagewise exposed silver halide emulsion layers in presence of suitable colour couplers by means of suitable colour-forming developer substances—so-called colour developers—whereby the oxidation product of the developer substances formed in correspondence with the silver image reacts with the colour coupler to form a dye image. Usually used as colour developers are aromatic compounds containing primary amino groups, especially those of the p-phenylenediamine type.

It is also known that the image dyes produced by chromogenic development undergo certain changes to different degrees under the influence of environmental conditions. This is particularly striking with regard to the effect of light. As is known, the magenta dyes produced from pyrazoloazole couplers fade particularly severely, while the cyan dyes produced from phenolic couplers have proved to have especially low vulnerability in this regard.

There has been no lack of attempts to remedy this defect by specific means. Namely in the case of the magenta couplers, improved light stability has been successfully achieved by light-stabilizing additives or special elaboration of the couplers. Suitable as light-stabilizing agents in the main are phenolic compounds, especially derivatives of hydroquinone, which are either admixed with the couplers or linked in the form of substituents with the coupler molecules (DE-B-1 547 803, DE-A-26 17 826, DE-A-29 52 511, JP-N 53 070 822, JP-N 54 070 830, JP-N 54 073 032). The known light stabilizers, however, still do not in every respect satisfy the requirements set.

The invention is based on the problem of indicating for photographic recording materials novel light stabilizers, especially such as are suitable for improving the light stability of the magenta image dyes produced from magenta couplers of the pyrazoloazole type.

The subject matter of the invention is a colour-photographic recording material comprising at least one silver halide emulsion layer and a colour coupler associated thereto, characterized in that it contains in a silver halide emulsion layer or in a non-light-sensitive binder layer adjacent thereto a combination of a pyrazoloazole coupler and a compound of general Formula I

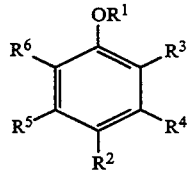

(I)

wherein $R^1$ represents H, a group that can be split off under alkaline conditions, alkyl or aryl;

$R^2$ represents —OH, alkyl, aryl, alkoxy or $$-(A)_n-\overset{\overset{\displaystyle R^7}{|}}{N}-CO-NH-R^8,$$

$R^3$, $R^4$, $R^5$ and $R^6$ represent H, —OH, —COOH —$SO_3H$, —$SO_2H$, alkyl, aryl, alkoxy, alkylsulphonyl, arylsulphonyl, optionally e.g. alkyl- and/or aryl-substituted sulphamoyl, acylamino or $$-(A)_n-\overset{\overset{\displaystyle R^7}{|}}{N}-CO-NH-R^8,$$

at least one of the groups $R^2$, $R^3$, $R^4$, $R^5$ and $R^6$ being a group of the formula $$-(A)_n-\overset{\overset{\displaystyle R^7}{|}}{N}-CO-NH-R^8;$$

A represents alkylene with 1–6 C atoms;

n represents 0 or 1, $R^7$ represents H or alkyl, optionally substituted for example with —COOH or —$SO_3H$, e.g. carboxymethyl;

$R^8$ represents optionally substituted alkyl, cycloalkyl or aryl with 4–20 C atoms, especially 10 to 18 C atoms;

$R^1$ and $R^3$ can form a 5- or 6-membered ring, in which case $R^2$=—OH or alkoxy;

$R^2$ and $R^4$ can form a 5- or 6-membered carbocyclic ring.

A group that can be split off under alkaline conditions, represented by $R^1$ is for example an acyl group that is derived from aliphatic or aromatic carboxylic acids: examples of groups that can be split off under alkaline conditions are acetyl, dichloroacetyl, alkoxycarbonyl and pyruvoyl.

An alkyl group represented by $R^2$ to $R^6$ contains preferably 1 to 4 C atoms: examples are methyl, ethyl, propyl, isopropyl, butyl, tert-butyl. An aryl group represented by $R^2$ to $R^6$ contains 6 to 10 C atoms: examples are phenyl and naphthyl, the alkyl and aryl groups can be further substituted, e.g. with halogen or alkyl. An alkoxy group represented by $R^2$ to $R^6$ can contain 1 to 18 C atoms. The acyl group in an acylamino group represented by $R^2$ to $R^6$ is derived from aliphatic or aromatic carboxylic or sulphonic acids. An alkyl, cycloalkyl or aryl group represented by $R^8$ can be singly- or poly-substituted, e.g. with a group of the formula

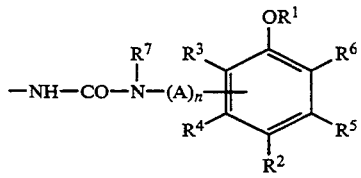

wherein $R^1$ to $R^7$, A and n have the meanings already given.

Examples of the stabilizers according to the invention are given in the following.

S-1
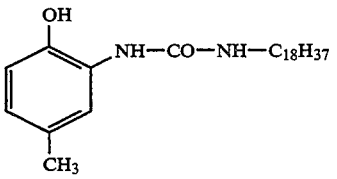
S-2
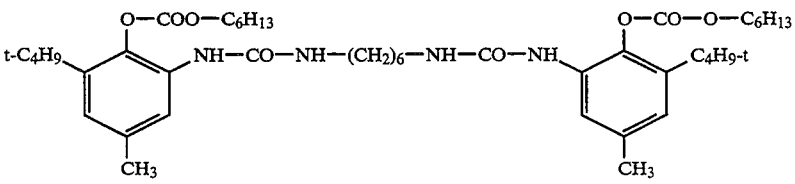
S-3
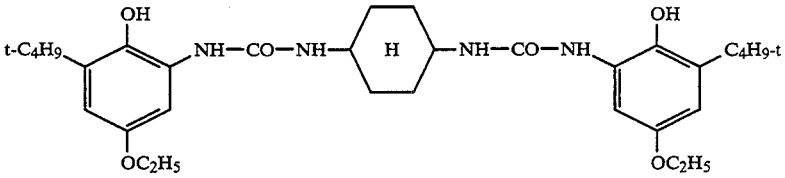
S-4
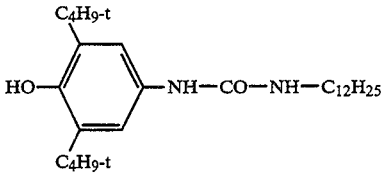
S-5
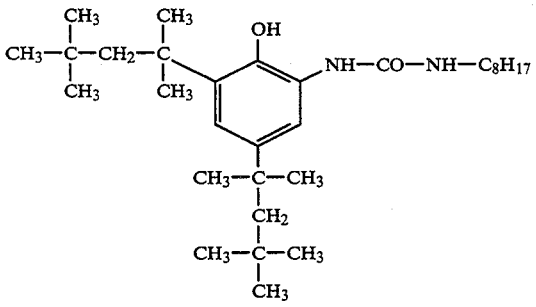
S-6
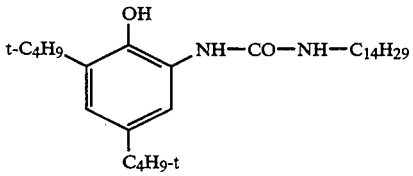
S-7
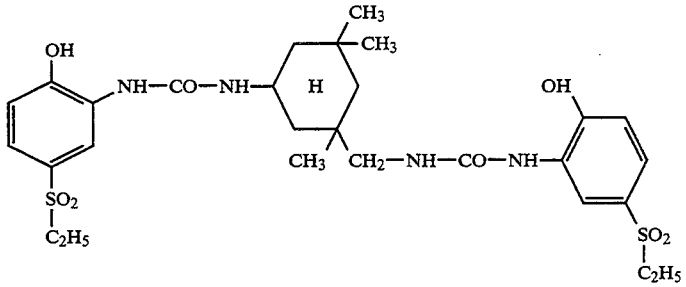

-continued
S-8
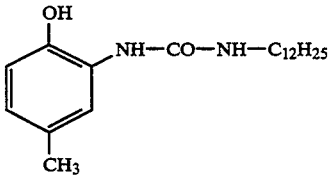
S-9
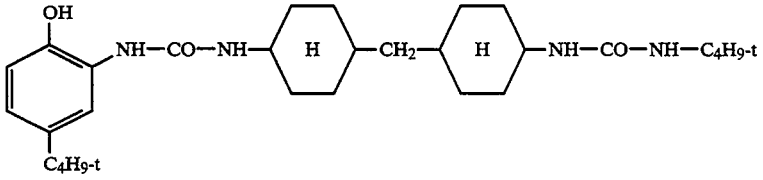
S-10
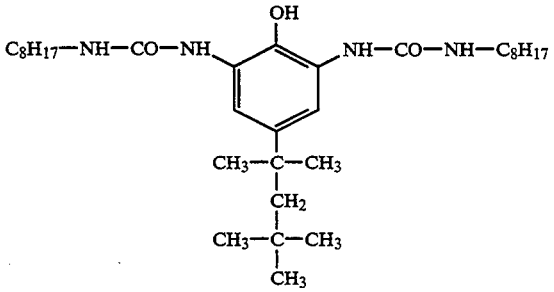
S-11
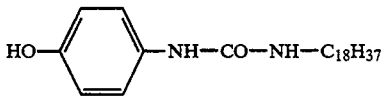
S-12
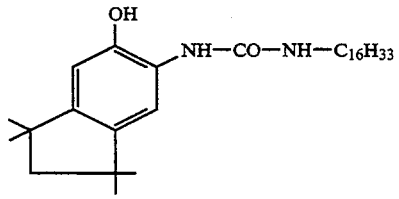
S-13
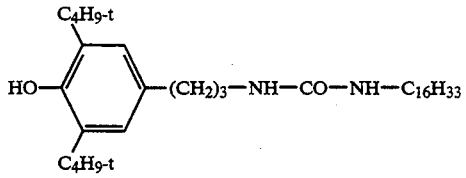
S-14
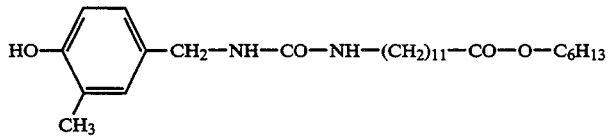
S-15
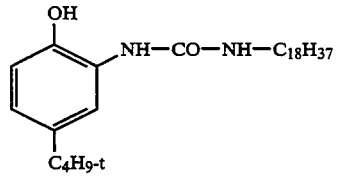

-continued

S-16

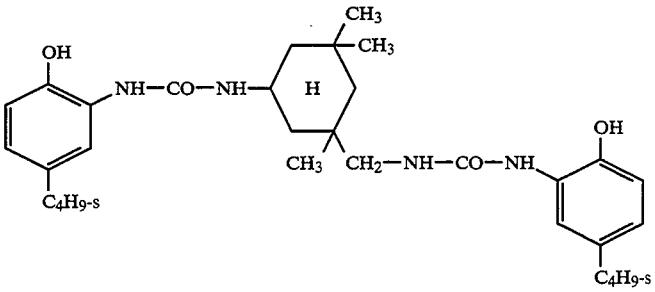

S-17

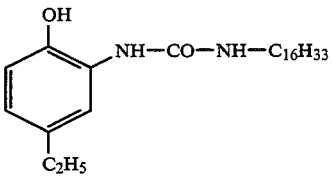

S-18

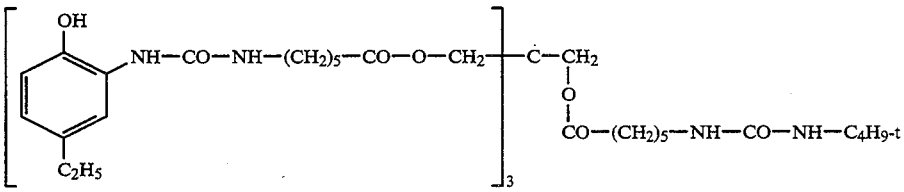

S-19

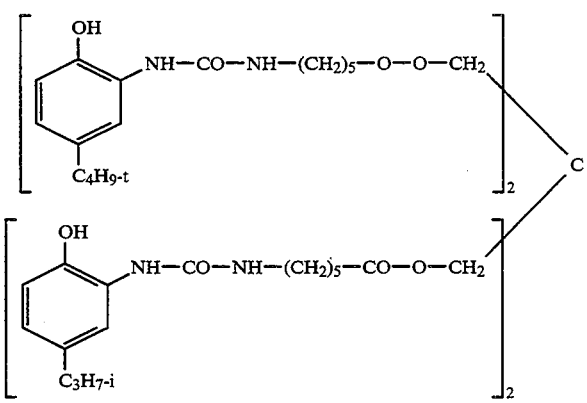

The compounds according to the invention can be produced simply by reaction of amines of Formula II with monomeric mono-, di- or polyisocyanates (II)

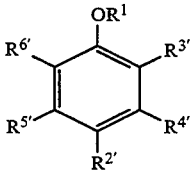

In Formula II, $R^1$, A and n have the meaning given with Formula I;

$R^{2'}$ represents —OH, alkyl, aryl, alkoxy or $—(A)_n—NH_2$;

$R^{3'}$, $R^{4'}$, $R^{5'}$ and $R^{6'}$ represent H, —OH, —COOH, $—SO_3H$, $—SO_2H$, alkyl, aryl, alkoxy, alkylsulphonyl, arylsulphonyl, optionally alkyl- and/or aryl-substituted sulphamoyl, acylamino or $—(A)_n—NH_2$, with the proviso that at least one of the groups $R^{2'}$, $R^{3'}$, $R^{4'}$, $R^{5'}$ and $R^{6'}$ represents $—(A)_n—NH_2$.

Suitable as isocyanates for the production of compounds of formula I are all aromatic and aliphatic isocyanates with 1 to 4 isocyanate groups such as e.g. 3-chlorophenyl isocyanate, phenyl isocyanate, 1,3-phenylene diisocyanate, 1,5-naphthylene diisocyanate, 4,4'-diphenylmethane diisocyanate, the isomers of tolylene diisocyanate, optionally a mixture, 2,4-bis(4-isocyanatobenzyl)-1-isocyanatobenzene, tris(4-isocyanatophenyl)methane, 2-ethyl-1,2,3-tris(3-isocyanato-4-methyl-anilinocarbonyloxy)propane, preferably the aliphatic mono and diisocyanates such as dodecyl isocyanate, cyclohexyl isocyanate, stearyl isocyanate, octyl isocyanate, hexadecyl isocyanate, hexane-1,6-diisocyanate, dicyclohexylmethane diisocyanate, cyclohexane-1,4-diisocyanate and isophorone diisocyanate.

Preparation of Compound S-1

To a solution of 67.7 g 2-hydroxy-5-methylaniline in 1000 ml acetone there is slowly added at 20° C. a solution of 147.5 g stearyl isocyanate in 500 ml acetone. After stirring for 6 hours, the acetone is distilled off in the rotary evaporator and the residue dissolved in ethyl acetate. The organic phase is thoroughly washed with 10% hydrochloric acid and dried over $Na_2SO_4$. Removal of the ethyl acetate by distillation yields 199 g S-1. The yield is 98%.

Compounds S-2 to S-14 are prepared analogously from the appropriate compounds of Formula II and isocyanates.

The colour-photographic recording material according to the invention contains at least one light-sensitive silver halide emulsion layer and preferably a succession of several such light-sensitive silver halide emulsion layers and optionally further auxiliary layers such as in particular abrasion-resistant layers and, disposed between the light-sensitive layers, non-light-sensitive binder layers, wherein according to the present invention a compound according to the invention in combination with a magenta coupler of the pyrazoloazole coupler type is associated with at least one of the light-sensitive silver halide emulsion layers present.

In this connection, the compounds according to the invention act primarily as light stabilizers, that is the azomethine dyes formed from the colour couplers during chromogenic development have in presence of the compounds according to the invention a considerably increased stability to the action of light. Besides that, the compounds according to the invention also in some cases undertake the function of an oil former for the colour coupler; that is they, together with other oil formers, can be used as coupler solvents. The compounds according to the invention then preferably make up 10 to 60 wt % of the total quantity of oil formers in the layer concerned. The circumstances that other oil formers are possibly only necessary in small amounts has a favourable effect on the layer weighting and/or the total layer thickness of the recording material according to the invention.

The compounds according to the invention are usually obtained from their preparation (reaction of compounds containing reactive hydrogen atoms with isocyanates) as low-melting solids and are used as a solution in aprotic (hydrophobic) solvents, e.g. ethyl acetate, when incorporating into the casting solution for the layer concerned, optionally together with the dye coupler concerned. The incorporation, for which further auxiliary solvents and/or high-boiling coupler solvents, so-called oil formers, can optionally be used, is carried out in the usual way.

The silver halide present as light-sensitive constituent in the photographic recording material according to the invention can contain chloride, bromide, iodide or mixtures thereof as the halide. For example, the halide content of at least one layer can consist of 0 to 15 mol % iodide, 0 to 100 mol % chloride and 0 to 100 mol % bromide. In the case of colour negative and colour reversal films, silver bromidel iodide emulsions are usually used, and in the case of colour negative and colour reversal paper, silver chloride bromide emulsions with a high proportion of chloride up to pure silver chloride emulsions are usually used. In can be a question of mainly compact crystals that are e.g. regular cubic or octahedral or can have transitional forms. Preferably, however, platelike crystals can also be present, whose average ratio of diameter to thickness is preferably at least 5:1, the diameter of a particle being defined as the diameter of a particle being defined as the diameter of a circle with an enclosed area corresponding to the projected area of the particle. The layers can, however, also have platy silver halide crystals in which the ratio of diameter to thickness is considerably greater than 5:1, e.g. 12:1 to 30:1.

The silver halide particles can also have a multiply laminated particle structure, in the simplest case with an inner and an outer particle zone (core/shell), wherein the halide composition and/or other modifications, such as e.g. doping of the individual zones of the particle, are different. The average particle size of the emulsions is preferably between 0.2 μm, and the particle size distribution can be both homo- or hetreodisperse. A homodisperse particle size distribution means that 95% of the particles do not deviate by more than ±30% from the mean particle size. The emulsions can also contain, apart from the silver halide, other silver salts, e.g. organic silver salts such as possibly silver benzotriazolate or silver behenate.

Two or several kinds of silver halide emulsions which are separately produced can be used as a mixture.

The emulsions can be chemically and/or spectrally sensitized in the usual way: they can also be stabilized by suitable additives. Suitable chemical sensitizers, spectral sensitizing dyes and stabilizers are described for example in Research Disclosure 17643 (December 1978); reference is made in particular to Chapters III, IV and VI.

The colour-photographic recording material according to the invention preferably contains, apart from the silver halide emulsion layer that contains the combination according to the invention of pyrazoloazole coupler and compound of Formula I and is normally sensitized to green light, further silver halide emulsion layers for recording light of the other spectral regions, red and blue. For this purpose, the light-sensitive layers are spectrally sensitized in known manner by suitable sensitizing dyes.

A survey of the polymethine dyes suitable as spectral sensitizers, their suitale combinations and combinations with super-sensitizing effect is given in Research Disclosure 17643 (December 1978), Chapter IV.

Suitable as green sensitizers, for example, are 9-ethylcarbocyanines with benzoxazole, naphthoxazole or a benzoxazole and a benzthiazole as basic end groups as well as benzimidazocarbocyanines, that can also be further substituted and must also contain at least one sulphoalkyl group on the heterocyclic nitrogen.

As examples, there can be mentioned, especially for negative and reversal film, the GS green sensitizers listed below, that can each be applied individually or in combination with each other, e.g. GS-1 and GS-2.

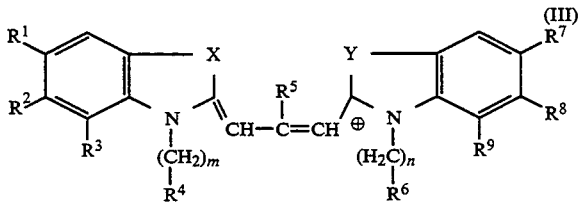

GS-1: $R^1, R^3, R^7, R^9 = H$; $R^2$ = phenyl;

$R^4 = -\underset{\underset{CH_3}{|}}{CH}-SO_3^{\ominus}\overset{\oplus}{N}H(C_2H_5)_3$; $R^5 = -C_2H_5$;

$R^6 = -SO_3^{\ominus}$; $R^8$ = Cl; m = 2; n = 3; X, Y = O;

GS-2: $R^1, R^2, R^7, R^8$ = Cl; $R^3, R^5, R^6, R^9 = H$;

$R^4 = -\underset{\underset{CH_3}{|}}{CH}-SO_3^{\ominus}$; m, n = 2; X, Y = $N-C_2H_5$;

-continued

GS-3: $R^1$, $R^7$ = H; $R^2$, $R^3$ as well $R^8$, $R^9$
—CH=CH—CH=CH—; $R^4 = SO_3^{\ominus}Na^{\oplus}$;
$R^5 = C_2H_5$; $R^6 = SO_3^{\ominus}$; m, n = 3; X, Y = O;

GS-4: $R^1$, $R^3$, $R^4$, $R^7$, $R^8$, $R^9$ = H;
$R^2 = -OCH_3$; $R^5 = -C_2H_5$;
$R^6 = SO_3^{\ominus}$; m = 2; n = 4; X = O; Y = S;

Each of the light-sensitive layers mentioned can consist of a single layer or, as is known e.g. in the so-called double-layer arrangement, also comprise two or even more silver halide emulsion component layers (DE-C-1 121 470). With negative films, red-sensitive silver halide emulsion layers are usually arranged closer to the film base than green-sensitive silver halide emulsion layers are, and these in turn closer than the blue-sensitive and there is generally between green-sensitive and blue-sensitive layers a non-light-sensitive yellow filter layer. But other arrangements are also possible, e.g. with colour paper. Between layers of different spectral sensitivity, a non-light-sensitive intermediate layer is usually arranged, that can contain an agent for preventing the undesired diffusion of developer oxidation products. If several silver halide emulsion layers of the same spectral sensitivity are present, these can be directly adjacent to each other or so disposed that between them there is a light-sensitive layer of another spectral sensitivity (DE-A-1 958 709, DE-A-2 530 645, DE-A-2 622 922).

Colour-photographic recording materials according to the invention usually contain, in spatial and spectral association with the silver halide emulsion layers of different spectral sensitivity, colour couplers for producing the different component colour images cyan, magenta and yellow, the compounds according to the invention together with the colour coupler concerned preferably being associated with a green-sensitive silver halide emulsion layer.

Spatial association means here that the colour coupler is in such a spatial relationship with the silver halide emulsion layer that an interaction between them is possible that permits an imagewise correspondence between the silver image formed during the development and the colour image produced from the colour coupler. This is usually achieved by the colour coupler being contained in the silver halide emulsion layer itself or in an optionally non-light-sensitive binder layer adjacent thereto.

Spectral association means that the spectral sensitivity of each of the light-sensitive silver halide emulsion layers and the colour of the component colour image produced from each spatially associated colour coupler are in a certain relationship with one another, whereby each of the spectral sensitivities (red, green, blue) is associated with another colour of the separation image concerned (in general e.g. with the colours cyan, purple or yellow in that order).

With each of the differently sensitized silver halide emulsion layers, one or several colour couplers can be associated. If several silver halide emulsion layers of the same spectral sensitivity are present, each of them can contain a colour coupler, and these colour couplers do not necessarily have to be identical. They should merely during colour development yield approximately the same colour, normally a colour that is complementary to the colour of the light to which the silver halide emulsion layers concerned are predominantly sensitive.

The colour couplers used according to the invention for producing the magenta partial image are couplers of the pyrazoloazole type; suitable examples of these are:

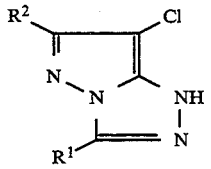

(IVa)

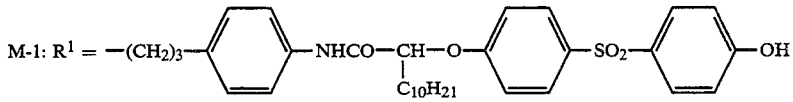

$R^2 = -CH_3$

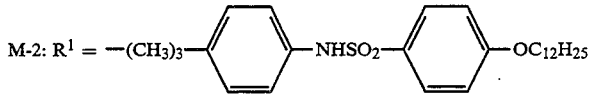

$R^2 = -CH_3$

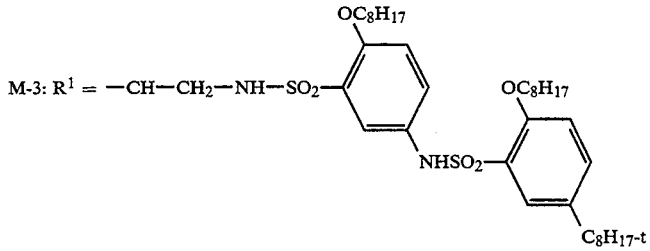

$R^2 = C_4H_9$-t

-continued
M-4: $R^1$ = 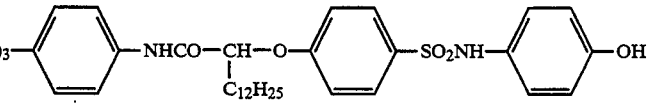
$R^2 = -CH_3$
M-5: $R^1$ = 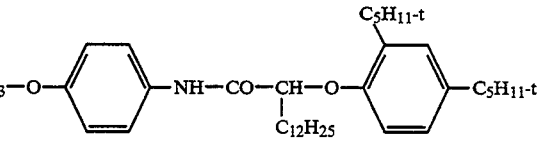
$R^2 = -CH_3$
M-6: $R^1 = -(CH_2)_2-SO_2-CH_2-CH(C_8H_{17})(C_6H_{13})$
$R^2 = -CH_3$
M-7: $R^1$ = 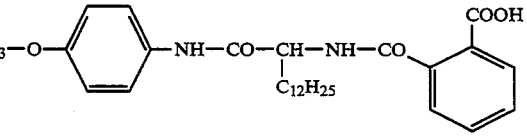
$R^2 = -CH_3$
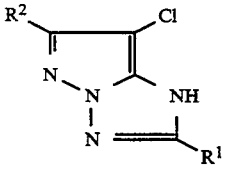
(Va)
M-8: $R^1$ = 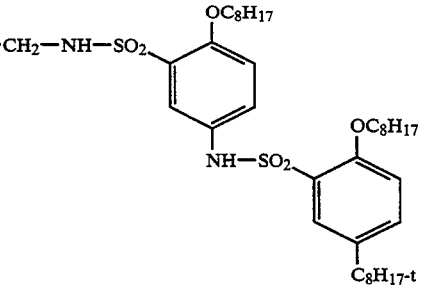
$R^2 = -CH_3$
M-9: $R^1$ = 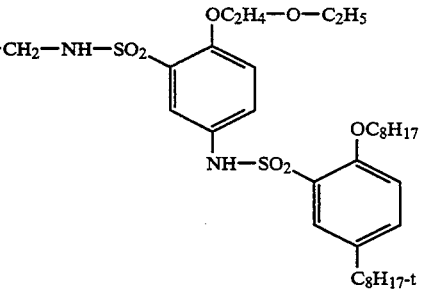
$R^2 = -CH_3$
M-10: $R^1$ = 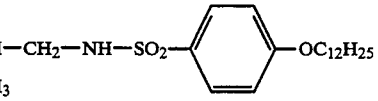
$R^2 = -C_3H_7\text{-i}$ -continued

M-11: $R^1 = CH_2-CH(CH_3)-NH-CO-CH(C_{12}H_{25})-O-C_6H_4-SO_2-C_6H_4-OH$ $R^2 = -CH_3$

M-12: $R^1 = -C_3H_7$-i $R^2 = -CH(CH_3)-CH_2-NH-SO_2-C_6H_3(OC_8H_{17})(C_8H_{17}\text{-t})$ M-13: $C_{18}H_{37}-N(CH_3)-SO_2-C_6H_4-$ 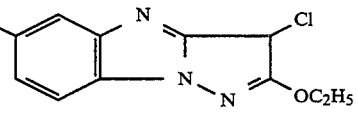

Pyrazoloazole couplers of the general Formulae IV and V are

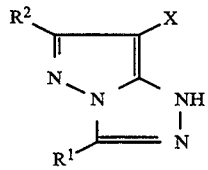

(IV)

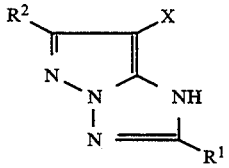

(V)

described for example in U.S. Pat. Nos. 3,725,067 and 4,540,654. In Formulae IV and V X represents H or a group that can be released under the conditions of dye coupling development;

$R^1$, $R^2$ represents H, alkyl, aralkyl, aryl, alkoxy, aroxy, alkylthio, arylthio, amino, anilino, acylamino, cyano, alkoxycarbonyl, carbamoyl or sulfamoyl, which groups can be further substituted.

Apart from the combination of pyrazoloazole coupler and compound of Formula I used according to the invention, the recording material according to the invention can contain in the layer concerned further couplers, especially magenta couplers, that do not have to belong to the pyrazoloazole class.

These further couplers but also 2-equivalent couplers. The latter are derived from the 4-equivalent couplers in that they contain a substituent in the coupling position that is split off during coupling. The 2-equivalent couplers include those that are colourless as well as those having an intense self-colour that during dye coupling disappears or is replaced by the colour of the image dye produced (mask couplers), but also the white couplers that by reaction with colour developer oxidation products yield essentially colourless products. Further to be included among the 2-equivalent couplers are such couplers as contain in the coupling position a group that can be split off and is released on reaction with colour developer oxidation products and then, either directly or after one or several other groups have been split off from the group primarily split off (e.g. DE-A-27 03 145, DE-A-28 55 697, DE-A-31 05 026, DE-A-33 19 428), displays a specific desirable photographic activity, e.g. as a development inhibitor or development accelerator. Examples of such 2-equivalent couplers are the known DIR couplers, as well as DAR and FAR couplers.

The couplers used, especially the magenta couplers of the pyrazoloazole type, for example of Formulae IV and V, used according to the invention, can also be applied in polymeric form, e.g. as a polymer latex.

High-molecular colour coupler are described for example in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 408,211. The high-molecular colour couplers are usually produced by polymerization of ethylenically unsaturated monomeric colour couplers.

The colour couplers used can also be those that provide dyes with a low or restricted mobility.

By low or restricted mobility is to be understood a mobility of such a degree that the outlines of the discrete spots of dyestuff formed in the chromogenic development run and become blurred into each other. This degree of mobility must be distinguished on the one hand from the usual case of complete immobility in photographic layers that is aimed at for the dye couplers or for the dyes produced therefrom in conventional photographic recording materials in order to achieve the greatest possible sharpness, and on the other hand from the case of complete mobility of the dyes that is aimed at for example in dye diffusion processes. The last-mentioned dyes usually have available at least one group that make them soluble in the alkaline medium. The degree of low mobility aimed at according to the invention can be controlled by variation of substituents in order for example deliberatly to influence the solubility of the oil former in the organic medium or the affinity for the binder matrix.

Beyond the constituents mentioned, the colour-photographic recording material of the present invention can contain other additives, such as for example antioxidants, dye-stabilizing agents and agents for influencing the mechanical and electrostatic properties as well as UV absorbers. Such additional compounds are advantageously combined with the compounds according to the invention, that is in the same binder layers adjacent to one another.

Additives for improving the stability of dyestuffs, couplers and whites as well as for reducing chemical fog (Research Disclosure 17 643 (December 1978), Chapter VII) can belong to the following classes of chemical substances: hydroquinones, 6-hydroxychromanes, 5-hydroxycumaranes, spirochromanes, spiroindanes, p-alkoxyphenols, sterically hindered phenols, gallic acid derivatives, methylenedioxybenzenes, aminophenols, sterically hindered amines, derivatives with esterified or etherified phenolic hydroxyl groups, and metal complexes.

Compounds that contain both a sterically hindered amine part-structure and a sterically hindered phenol part-structure in one molecule (U.S. Pat. No. 4,268,593) are especially effective in preventing the impairment of yellow colour images as a result of the development of heat, moisture and light. For preventing the impairment of purple colour images, especially as a result of the action of light, spiroindanes (JP-A-159 644/81) and chromanes substituted by hydroxy or alkoxy groups (JP-A-89 835/80) are especially effective.

Examples of especially effective compounds are:

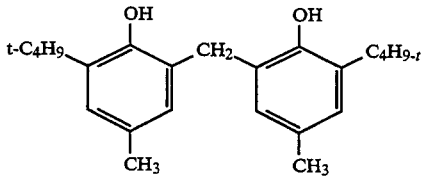

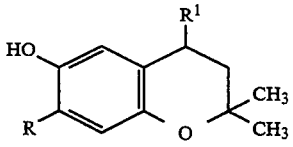

$R = -C_8H_{17}\text{-t}$; $R^1 = -CH_3$
$R = -C_8H_{17}$ ; $R^1 = -C_3H_7\text{-i}$

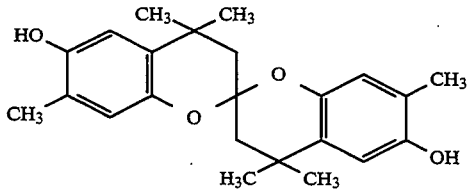

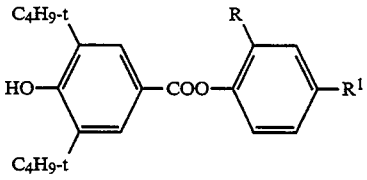

$R, R^1 = -C_4H_9\text{-t}$
$R, R^1 = -C_5H_{11}\text{-t}$

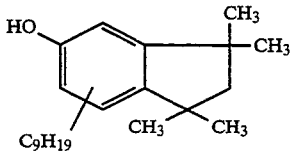

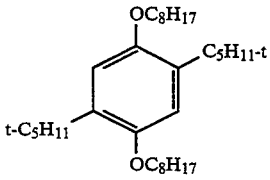

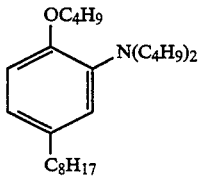

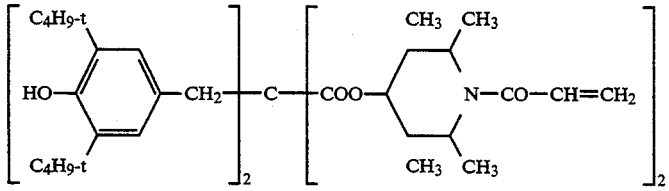

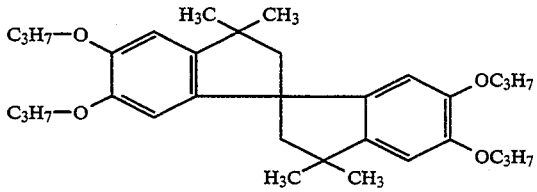

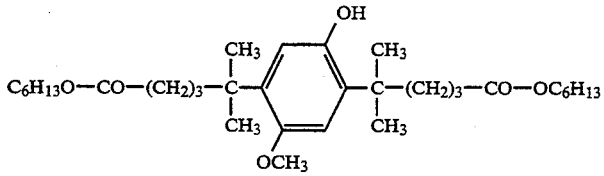

UV-light-absorbing compounds are intended on the one hand to protect the image dyes from bleaching by UV-rich daylight and on the other hand as filter dyes to absorb the UV light in the daylight during the exposure and so improve the colour reproduction of a film. Usually, compounds of different structure are applied for the two tasks. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamate ester compounds (U.S. Pat. Nos. 3,705,805 and 3,707,375), butadiene compounds (U.S. Pat. No. 4,045,229 or benzoxazole compounds (U.S. Pat. No. 3,700,455).

Examples of especially suitable compounds are

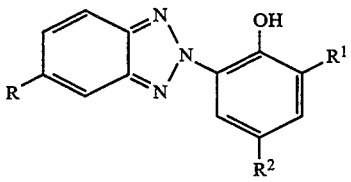

$R, R^1 = H; R^2 = \text{-tert-}C_4H_9$ $R = H; R^1, R^2 = \text{-tert-}C_4H_9$ $R = H; R^1, R^2 = \text{-tert-}C_5H_{11}$ $R = H; R^1 = \text{-sec-}C_4H_9; R^2 = \text{-tert-}C_4H_9$ $R = Cl; R^1 = \text{-tert-}C_4H_9; R^2 = \text{-sec-}C_4H_9$ $R = Cl; R^1, R^2 = \text{-tert-}C_4H_9$ $R = Cl; R^1 = \text{-tert-}C_4H_9; R^2 = -CH_2-CH_2-COOC_8H_{17}$ $R = H; R^1 = \text{-iso-}C_{12}H_{25}; R^2 = -CH_3$ $R, R^1, R^2 = \text{-tert-}C_4H_9$

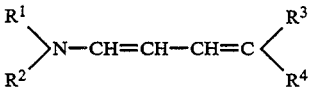

$R^1, R^2 = -C_6H_{13}; R^3, R^4 = -CN$ $R^1, R^2 = -C_2H_5; R^3 = -SO_2-$ 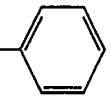 ;

$R^4 = -CO-OC_8H_{17}$ $R^1, R^2 = -C_2H_5; R^3 = -SO_2-$ 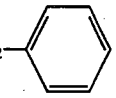 ;

$R_4 = -COO-C_{12}H_{25}$ $R^1, R^2 = -CH_2=CH-CH_2; R^3, R^4 = -CN$

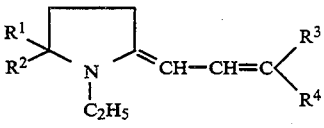

$R^1, R^2 = H; R^3 = -CN; R^4 = -CO-NHC_{12}H_{25}$ $R^1, R^2 = -CH_3; R^3 = -CN; R^4 = -CO-NHC_{12}H_{25}$

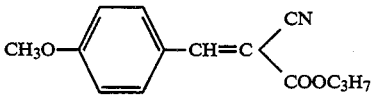

Ultraviolet-absorbing couplers (such as blue-green couplers of the α-naphthol type) and ultraviolet-absorbing polymers can also be used. These ultraviolet absorbers can be fixed by mordanting in a special layer.

For producing colour-photographic images, the colour-photographic recording material according to the invention that contains a colour coupler and a compound of Formula I associated with at least one silver halide emulsion layer, is developed with a colour developer compound. Any developer compound can be used as a colour developer compound that is capable of reacting in the form of its oxidation product with colour couplers to azomethine dyes. Suitable colour developer compounds are aromatic compounds of the p-phenylenediamine type containing at least one primary amino group, for example N,N-dialkyl-p-phenylenediamines such as N,N-diethyl-p-phenylenediamine, 1-(N-ethyl-N-methylsulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

Other useful colour developers are described for example in J. Amer. Chem. Soc. 73, 3100 (1951) and G. Haist, Modern Photographic Processing, 1979, John Wiley and Sons, New York, pages 545 ff.

After the colour development, the material is usually bleached and fixed. Bleaching and fixing can be carried out separately from each other or also together. As bleaching agents, the usual compounds can be used, e.g. $Fe^{3+}$ salts and $Fe^{3+}$ complex salts such as ferricyanides, dichromates and water-soluble cobalt complexes etc. Especially preferred are iron(III) complexes of aminopolycarboxylic acids, especially e.g. of ethylenediaminetetraacetic acid, alkyliminodicarboxylic acids and corresponding phosphonic acids. Furthermore, persulphates are suitable as bleaching agents.

EXAMPLES

Example 1

Sample 1 (comparative)

A film base of paper coated on both sides with polyethylene was provided with the following layers. The quantities quoted relate to 1 $m^2$.

Layer 1 A substrate layer of 200 mg gelatin with addition of $KNO_3$ and chrome alum.

Layer 2 An adhesive layer of 320 mg gelatin.

Layer 3 A green-sensitive silver bromide chloride emulsion layer (20 mol % chloride) of 530 mg $AgNO_3$ with 750 mg gelatin 0.61 g magenta coupler M-5, emulsified with 0.61 g tricresyl phosphate (TCP)

Layer 4 An abrasion resistant layer of 1 g gelatin and 16 mg of a wetting agent of the formula $$C_8F_{17}SO_3^{\ominus}N(C_2H_5)_4^{\oplus} \qquad \text{(NH-1)}$$

On this layer a hardening layer is applied, containing 120 mg per $m^2$ of a hardener of the formula

HM-1

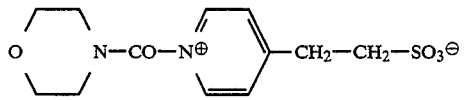

Sample 2 to 12

Samples 2 to 12 were prepared in the same way as Sample 1, with the difference that the tricresyl phosphate used in Sample 1 was replaced in Sample 2 (compare also Samples 6 to 9) and that for Samples 3 to 12 a light stabilizer was used in addition, namely for Samples 3–11 a compound of Formula I (according to the invention) and for Sample 12 the comparative compound of the formula:

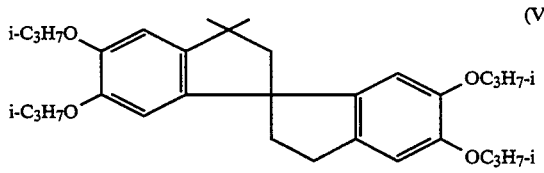

(VP-1)

Samples 1–12 contained as oil formers either tricresyl phosphate or dibutyl phthalate (see Table 1).

The samples obtained were exposed behind a graduated grey wedge. The materials were then processed with the processing baths listed below in the following way.

| | |
|---|---|
| Development | 210 s, 33° C. |
| Bleaching | 50 s, 20° C. |
| Fixing | 60 s, 20° C. |
| Washing | 120 s, 20° C. |
| Drying | |
| Composition of the baths | |
| Developer | |
| Benzyl alcohol | 13 ml |
| Hydroxylamine sulphate | 3 g |
| Sodium sulphite | 2 g |
| 4-amino-N-ethyl-N(β-methanesulphonamidoethyl)-m-toluidine sesquisulphate (monohydrate) | 4.5 g |
| Potassium carbonate | 36 g |
| Potassium bromide | 1.4 g |
| Diethylenetriaminopentaacetic acid, pentasodium salt | 2 g |
| Diethylene glycol | 12 ml |
| made up to 1 liter with water | |
| pH = 10.4 | |
| Bleaching bath | |
| Water | 700 ml |
| $NH_4$-Fe-EDTA | 65 g |
| EDTA | 10 g |
| $MH_4Br$ | 100 g |
| adjust with acetic acid to pH 6.0 | |
| make up to 1 liter with water | |
| Fixing bath | |
| Ammonium thiosulphate | 100 g |
| Na sulphite, dry | 10 g |
| Na bisulphite | 3 g |
| make up to 1 liter with water | |

After that the maximum colour density is measured (Table 1).

In addition the samples were exposed to the light of a xenon lamp standardized for daylight and illuminated with $4.2\times10^6$ l×h; after that the percentage loss of density was measured (Table 1).

TABLE 1

| Sample | Oil-former | Light stabilizer | $D_{max}$ | % Density reduction at D = 0.5 | 1.0 | $D_{max}$ |
|---|---|---|---|---|---|---|
| 1 (comparative) | tricresyl phosphate | — | 2.22 | 79 | 84 | 68 |
| 2 (comparative) | dibutyl phthalate | — | 2.18 | 81 | 88 | 71 |
| 3 (according to the invention) | tricresyl phosphate | 0.31 g compound S-1 | 2.32 | 38 | 36 | 18 |
| 4 (according to the invention) | tricresyl phosphate | 0.62 g compound S-1 | 2.39 | 33 | 21 | 12 |
| 5 (according to the invention) | tricresyl phosphate | 0.31 g compound S-5 | 2.30 | 66 | 58 | 23 |
| 6 (according to the invention) | dibutyl phthalate | 0.31 g compound S-6 | 2.29 | 68 | 60 | 24 |
| 7 (according to the invention) | dibutyl phthalate | 0.31 g compound S-7 | 2.29 | 39 | 36 | 18 |
| 8 (according to the invention) | dibutyl phthalate | 0.62 g compound S-7 | 2.34 | 35 | 30 | 13 |
| 9 (according to the invention) | dibutyl phthalate | 0.31 g compound S-8 | 2.28 | 42 | 39 | 21 |
| 10 (according to the invention) | tricresyl phosphate | 0.31 g compound S-9 | 2.31 | 60 | 55 | 32 |
| 11 (according to the invention) | tricresyl phosphate | 0.31 g compound S-12 | 2.28 | 68 | 57 | 21 |
| 12 (comparative) | tricresyl phosphate | 0.31 g compound VP-1 | 2.31 | 72 | 73 | 40 |

The example shows that through the compounds according to the invention, high maximum colour densities are achieved and simultaneously the light stability of the image dye is improved. The compound VP-1 according to GB 2 135 788 used for comparison causes a smaller improvement of the light stability of the image dye is improved. The compound VP-1 according to GB 2 135 788 used for comparison causes a smaller improvement of the light stability.

Example 2

A layer structure as described in Example 1 is prepared, with the difference that in the green sensitive layer, instead of the magenta coupler M-5, the magenta coupler M-14 is used. In this way Sample 13 (comparative) is obtained.

Samples 14–18 are prepared in the same way as Sample 13, with the difference that to Layer 3 in Sample 13 one of the compounds according to the invention was added. Sample 19 is prepared similarly, using the comparative compound VP-1. The processing and testing is carried out as described in Example 1.

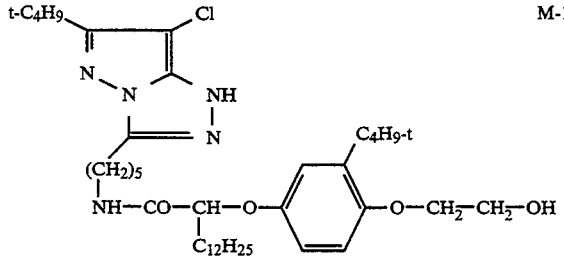

M-14

TABLE 2

| Sample | Oil-former | Light stabilizer | $D_{max}$ | % Density reduction at D = 0.5 | 1.0 | $D_{max}$ |
|---|---|---|---|---|---|---|
| 13 (comparative) | tricresyl phosphate | — | 1.49 | 54 | 57 | 35 |
| 14 (according to the invention) | tricresyl phosphate | 0.31 g compound S-1 | 1.52 | 29 | 23 | 14 |
| 15 (according to the invention) | tricresyl phosphate | 0.62 g compound S-1 | 1.55 | 23 | 17 | 8 |
| 16 (according to the invention) | dibutyl phthalate | 0.31 g compound S-7 | 1.50 | 30 | 25 | 16 |
| 17 (according to the invention) | dibutyl phthalate | 0.62 g compound S-7 | 1.52 | 23 | 18 | 9 |
| 18 (according to the invention) | tricresyl phosphate | 0.31 g compound S-12 | 1.52 | 30 | 29 | 18 |

TABLE 2-continued

| Sample | Oil-former | Light stabilizer | $D_{max}$ | % Density reduction at D = 0.5 | 1.0 | $D_{max}$ |
|---|---|---|---|---|---|---|
| 19 (comparative) | tricresyl phosphate | 0.31 g compound VP-1 | 1.51 | 35 | 34 | 22 |

The example shows that through the use of the compounds according to the invention, the light stability of the image dyes is improved. The compound VP-1 according to GB 2 135 788 used for comparison causes a smaller improvement of the light stability.

Example 3

A color photographic recording material for rapid processing was prepared by application of the following layers in the order indicated to a layer support of paper coated on both sides with polyethylene. The quantities shown are all based on 1 $m^2$. For the silver halide applied, the corresponding quantities of $AgNO_3$ are shown.

Sample 20

1st layer (substrate layer) 0.2 g gelatine

2nd layer (blue-sensitive layer): blue-sensitive silver halide emulsion (99.5 mol-% chloride, 0.5 mol-% bromide, average grain diameter 0.8 μm) of 0.63 g $AgNO_3$ containing 1.38 g gelatine 0.95 g yellow coupler Y-1 0.2 g white coupler W-1 0.29 g tricresyl phosphate (TCP)

3rd layer (protective layer) 1.1 g gelatine 0.06 g 2,5-dioctyl hydroquinone 0.06 g dibutyl phthalate (DBP)

4th layer (green-sensitive layer) green-sensitized silver halide emulsion (99.5 mol-% chloride, 0.5 mol-% bromide, average grain diameter 0.6 μm) of 0.45 g $AgNO_3$ containing 1.08 g gelatine 0.40 g magenta coupler M-15 0.08 g 2,5-dioctyl hydroquinone 0.34 g DBP 0.04 g TCP 5th layer (UV-absorbing layer) 1.15 g gelatine 0.6 g UV absorber corresponding to the formula

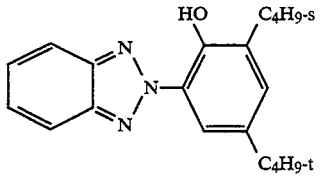

0.045 g 2,5-dioctyl hydroquinone 0.04 g TCP

6th layer (red-sensitive layer) red-sensitised silver halide emulsion (99.5 mol-% chloride, 0.5 mol-% bromide, average grain diameter 0.5 μm) of 0.3 g $AgNO_3$ containing 0.75 g gelatine 0.36 g cyan coupler C-1 0.36 g TCP 7th layer (UV-absorbing layer) 0.35 g gelatine 0.15 g of the same UV absorber as in the 5th layer 0.2 g TCP 8th layer (protective layer) 0.9 g gelatine 0.3 g hardener carbamoyl pyridinium salt (CAS Reg. No. 65411-60-1)

The following compounds were used:

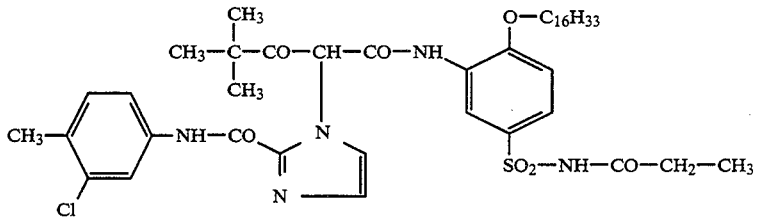

Y-1

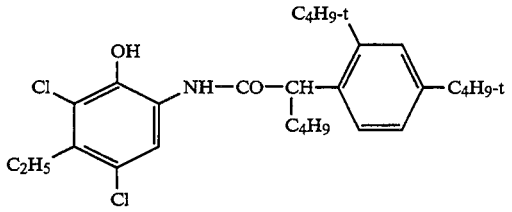

C-1

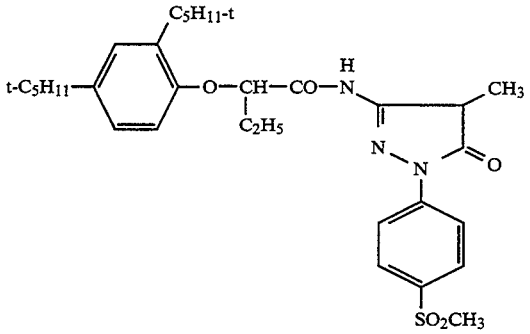

W-1

-continued

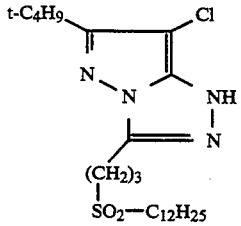

M-15

Samples 21 to 27

Samples 21 to 27 were prepared in the same way as Sample 20 with the exception that a light stabilizer of formula I according to the invention was added comparison compounds VP-1 and VP-2 were added shown in Table 3.

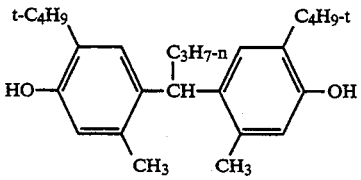

VP-2

The samples obtained were exposed behind a graduated grey wedge and were then processed using the processing baths indicated below.

| | | | |
|---|---|---|---|
| a) | color developer | 45 s | 35° C. |
| | Triethanolamine | | 9,0 g |
| | N,N-Diethylhydroxylamine | | 4,0 g |
| | Diethylenglykol | | 0,05 g |
| | 3-methyl-4-amino-N-ethyl-N-methan-sulfonamidoethyl-anilin-sulfate | | 5,0 g |
| | Potassium sulfite | | 0,2 g |
| | Triethylenglykol | | 0,05 g |
| | Potassiumcarbonate | | 22 g |
| | Potassium hydroxide | | 0,4 g |
| | Disodium ethylendiamintetraacetate | | 2,2 g |
| | Potassium chloride | | 2,5 g |
| | 1,2-Dihydroxybenzene-3,4,6-trisulfic acid-trisodium salt | | 0,3 g |
| | make up with water to 1,000 ml; pH 10,0 | | |
| b | Blix | 45 s | 35°C. |
| | Ammonium thiosulfate | | 75 g |
| | Sodium hydrogensulfite | | 13,5 g |
| | Ammonium acetate | | 2,0 g |
| | Ethylendiamintetracetic acid Fe/$NH_4$-salt | | 57 g |
| | Ammonia 25% | | 9,5 g |
| | Acetic acid | | 9,0 g |
| | make up with water to 1,000 ml; pH 5,5 | | |
| c) | Rinsing | 2 min | 33° C. |

The maximum color density was determined in all of the Samples 20 to 27. Further the samples were exposed for $9.6\times10^6$ lx.h to the light of a Xenon lamp standardized for daylight. The percent decrease in density was then measured as shown in Table 3.

TABLE 3

| Sample | light stabilizer | $D_{max}$ | Density decrease [%] at D = 0,5 | 1,0 | $D_{max}$ |
|---|---|---|---|---|---|
| 20 (Comparison) | — | 2.31 | 84 | 79 | 32 |
| 21 (according to the invention) | 0,30 g Compound S-1 | 2.41 | 40 | 33 | 9 |
| 22 (according to the invention) | 0,30 g Compound S-7 | 2.39 | 38 | 31 | 8 |
| 23 (according to the invention) | 0,30 g Compound S-15 | 2.42 | 50 | 41 | 12 |
| 24 (according to the invention) | 0,40 g Compound S-15 | 2.40 | 41 | 31 | 9 |
| 25 (according to the invention) | 0,30 g Compound S-17 | 2.41 | 49 | 43 | 10 |
| 26 (Comparison) | 0,30 g Compound VP-1 | 2.36 | 68 | 62 | 24 |
| 27 (Comparison) | 0,30 g Compound VP-2 | 2.38 | 62 | 56 | 20 |

This Examples shows that the light stability of the image dyes is substantially improved by use of the compounds of the present invention as compared to the comparison compounds VP-1 and VP-2.

Example 4

A colour photographic recording materials suitable for reversal processing was produced by successive application of the following layers in the order given to a transparent layer support of cellulose triacetate provided with an adhesive layer. The quantities shown are all based on 1 $m^2$ For the silver halide applied the corresponding quantities of $AgNO_3$ are shown.

Sample 28

Layer 1 (Antihalo layer) black colloidal silver sol containing 0.25 g Ag 1.60 g gelatine 0.24 g UV Absorber UV-1

Layer 2 (Interlayer) 0.64 g gelatine

Layer 3 (First red-sensitive layer) red-sensitized silver halide emulsion (mean grain diameter 0.25 μm, 97.5 mol-% bromide, 2.5 mol-% iodide) of 0.60 g of $AgNO_3$, containing 0.59 g gelatine 0.24 g cyan coupler C-2 0.12 g TCP Layer 4 (Second red-sensitive layer) red-sensitized silver halide emulsion (mean grain diameter 0.43 μm, 97 mol-% bromide, 3 mol-% iodide) of 0.95 g of $AgNO_3$, containing 1.96 g gelatine 0.95 g cyan coupler C-2 0.48 g TCP Layer 5 (Interlayer) 1.78 g gelatine 0.24 g compound SC-1 0.12 g TCP Layer 6 (First green-sensitive layer) a mixture 3:1 of silver halide emulsion (mean grain diameter 0.26 μm; 99.0 mol-% bromide and 1.0 mol-% iodide) and a silver halide emulsion (96.0 mol-% bromide and 4.0 mol-% iodide; mean grain diameter 0.21 μm), both green-sensitized, of 0.67 g of $AgN_3$, containing 1.13 g gelatine 0.22 g magenta coupler M-16 0.10 g TCP Layer 7 (Second green-sensitive layer) green-sensitized silver halide emulsion (mean grain diameter 0.42 μm, 98.5 mol-% bromide and 1.5 mol-% iodide) of 1.05 g of $AgNO_3$, containing 2.72 g gelatine 0.68 g magenta coupler M-16 0.45 g TCP Layer 8 (Interlayer) 0.55 g gelatine 0.10 compound SC-1

Layer 9 (Yellow filter layer) yellow colloidal silver sol, containing 0.11 g silver 0.45 g gelatine Layer 10 (Interlayer) 0.71 g gelatine Layer 11 (First blue-sensitive layer) blue-sensitized silver halide emulsion (mean grain diameter 0.28 μm, 96 mol-% bromide and 4 mol-% iodide) of 0.58 g of $AgNO_3$, containing 1.31 g gelatine 0.24 g yellow coupler Y-2 0.12 g TCP Layer 12 (Second blue-sensitive layer) blue-sensitized silver halide emulsion (mean grain diameter 0.66 μm, 97 mol-% bromide and 3 mol-% iodide) of 0.66 g of $AgNO_3$, containing 2.04 g gelatine 0.83 g yellow coupler Y-2 0.41 g TCP Layer 13 (Interlayer) 0.76 g gelatine 0.54 g compound SC-1 0.50 g UV Absorber UV-2 0.02 g TCP Layer 14 (Interlayer) silver halide emulsion of the Lippmann type (mean grain diameter 0.15 μm, 96 mol-% bromide and 4 mol-% iodide) of 0.20 g of $AgNO_3$, containing 0.57 g gelatine Layer 15 (Protective layer) 0.25 g gelatine 0.97 g hardening agent carbamoyl pyridinium salt (CAS Reg. No. 65411-60-1).

The following compounds were used

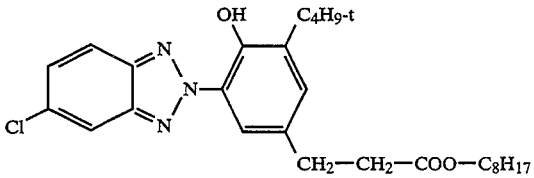

UV-1

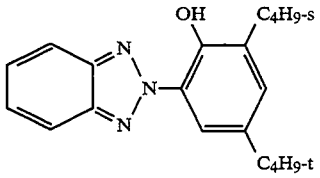

UV-2

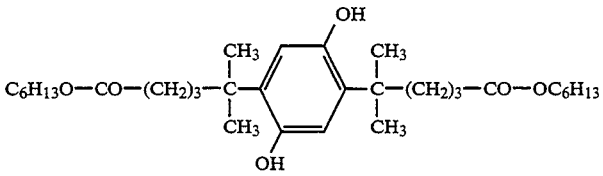

SC-1

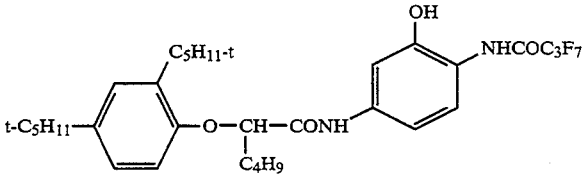

C-2

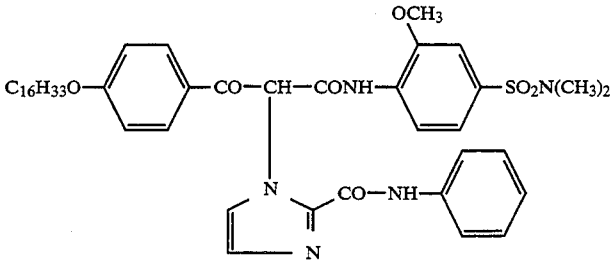

Y-2

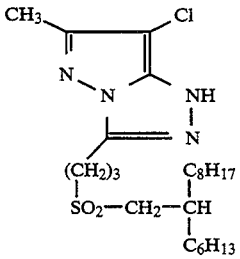

M-16

Samples 29–33

Samples 29–33 were prepared substantially in the same way as sample 28, with the exception that a compound according to the present invention was added to layers 6 and 7 of samples 29–32 and that the comparison compound VP-2 was added to layers 6 and 7 of sample 33.

The samples prepared in this way were exposed under a step wedge and subjected to color reversal processing as described in "Manual for PROCESSING Kodak Ektachrome Film using Process E7", Eastman Kodak Company, 1977 (cf. Kodak Publication No. Z-119).

The maximum color density was determined as shown in Table 4. The samples 28–33 were exposed for $7.2\times10^6$ lx.h to the light of a Xenon lamp standardized for daylight. The percent decrease in density was then measured as shown in Table 4.

TABLE 4

| Sample | Lightstabilizer | Amount percent by weight on M-16 | $D_{max}$ | Density decrease [%] at D = 0.5 | 1.0 | $D_{max}$ |
|---|---|---|---|---|---|---|
| 28 (Comparison) | — | — | 3.96 | 86 | 53 | 29 |
| 29 (Invention) | Compound S-1 | 50 | 4.51 | 61 | 30 | 15 |
| 30 (Invention) | Compound S-7 | 50 | 4.48 | 62 | 29 | 14 |
| 31 (Invention) | Compound S-15 | 50 | 4.46 | 67 | 34 | 18 |
| 32 (Invention) | Compound S-17 | 50 | 4.49 | 62 | 31 | 16 |
| 33 (Comparison | Compound VP-2 | 50 | 3.98 | 76 | 44 | 23 |

This example shows that the compounds according to the present invention improve the light stability of the image dyes. Compound VP-2 used for comparison improves the light stability to a lesser extent.

We claim:

1. A color-photographic recording material comprising at least one silver halide emulsion layer and a dye coupler associated with this, characterized in that the recording material contains, in at least one light-sensitive silver halide emulsion layer, a combination of a pyrazoloazole coupler and a compound of general Formula I

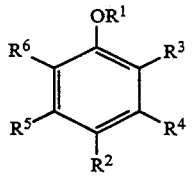

(I)

wherein $R^1$ represents H, a group that can be split off under alkaline conditions, alkyl or aryl;

represents —OH, alkyl, aryl, alkoxy or $$-(A)_n-\overset{R^7}{\overset{|}{N}}-CO-NH-R^8,$$

$R^3$, $R^4$, $R^5$ and $R^6$ represent H, —OH, —COOH, $-SO_3H$, $-SO_2H$, alkyl, aryl, alkoxy, alkylsulphonyl, arylsulphonyl, optionally substituted sulphamoyl, acylamino or $$-(A)_n-\overset{R^7}{\overset{|}{N}}-CO-NH-R^8,$$

at least one of the groups $R^2$, $R^3$, $R^4$, $R^5$ and $R^6$ being a group of the formula $$-(A)_n-\overset{R^7}{\overset{|}{N}}-CO-NH-R^8,$$

A represents alkylene with 1–6 carbon atoms;

n represents 0 or 1, $R^7$ represents H or optionally substituted alkyl;

$R^8$ represents a member selected from the group consisting of alkyl, cycloalkyl and aryl, wherein when said alkyls, cycloalkyls and aryls are substituted, they contain at least one additional group of formula

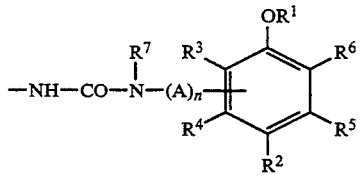

wherein $R^1$ to $R^7$, A and n have the meanings provided above;

$R^1$ and $R^3$ can form a 5- or 6-membered ring, in which case $R^2$=—OH or alkoxy;

$R^2$ and $R^4$ can form a 5- or 6-membered carbocyclic ring.

2. A recording material according to claim 1, characterized in that the pyrazoloazole coupler corresponds to one of the formulae IV and V

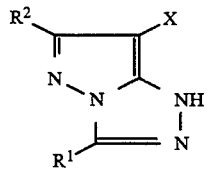

(IV)

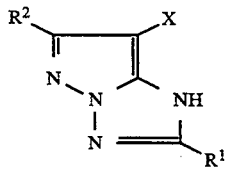

(V)

wherein

X represents H or a group that can be released under the conditions of dye coupling development;

$R^1$, $R^2$ represents H, alkyl, aralkyl, aryl, alkoxy, aroxy, alkylthio, arylthio, amino, anilino, acylamino, cyano, alkoxycarbonyl, carbamoyl and sulphamoyl, which groups can be further substituted.

3. A color-photographic recording material according to claim 1, wherein said compound of general formula I is

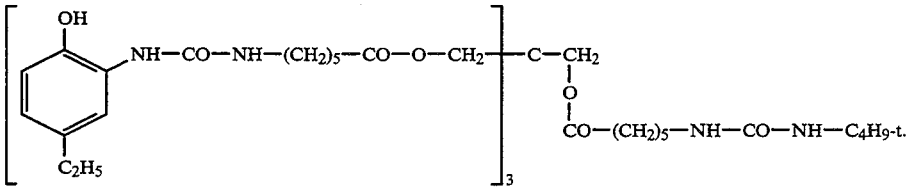
4. A color-photographic recording material according to claim 1, wherein said compound of general formula I is
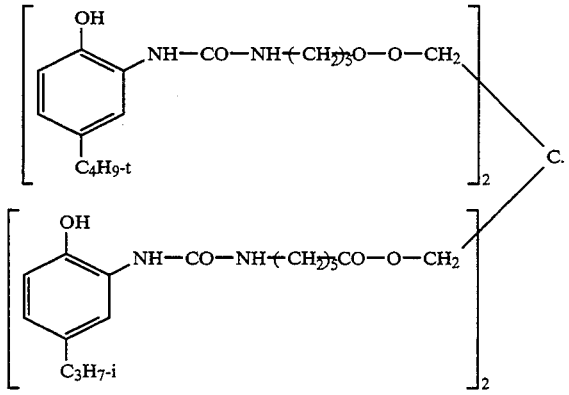
* * * * *

UNITED STATES PATENT AND TRADEMARK OFFICE

CERTIFICATE OF CORRECTION

PATENT NO. : 5,340,709

DATED : August 23, 1994

INVENTOR(S) : Hagemann et al

It is certified that error appears in the above-indentified patent and that said Letters Patent is hereby corrected as shown below:

Column 29, line 47, should read --$R^2$ represents -OH, alkyl, aryl, alkoxy or--.

Signed and Sealed this

Fifth Day of September, 1995

*Attest:*

Bruce Lehman

BRUCE LEHMAN

*Attesting Officer*

*Commissioner of Patents and Trademarks*